US008199057B2

(12) United States Patent
Ishizuka et al.

(10) Patent No.: US 8,199,057 B2
(45) Date of Patent: Jun. 12, 2012

(54) ANTENNA DEVICE AND WIRELESS COMMUNICATION APPARATUS

(75) Inventors: Kenichi Ishizuka, Yokohama (JP); Kazunari Kawahata, Yokohama (JP); Nobuhito Tsubaki, Sagamihara (JP)

(73) Assignee: Murata Manufactruing Co., Ltd., Kyoto (JP)

( * ) Notice: Subject to any disclaimer, the term of this patent is extended or adjusted under 35 U.S.C. 154(b) by 208 days.

(21) Appl. No.: 12/360,527

(22) Filed: Jan. 27, 2009

(65) Prior Publication Data

US 2009/0128428 A1 May 21, 2009

Related U.S. Application Data

(63) Continuation of application No. PCT/JP2007/062891, filed on Jun. 27, 2007.

(30) Foreign Application Priority Data

Jul. 28, 2006 (JP) ..... 2006-206983

(51) Int. Cl.
*H01Q 1/38* (2006.01)

(52) U.S. Cl. ..... 343/700 MS; 343/702; 343/745

(58) Field of Classification Search ..... 343/745, 343/723, 749, 700 MS, 702
See application file for complete search history.

(56) References Cited

U.S. PATENT DOCUMENTS 6,583,685 B1 * 6/2003 Easter et al. ..... 333/32
6,614,398 B2 * 9/2003 Kushihi et al. ..... 343/700 MS
6,680,705 B2 * 1/2004 Tan et al. ..... 343/700 MS
6,693,594 B2 * 2/2004 Pankinaho et al. .... 343/700 MS
7,136,020 B2 * 11/2006 Yamaki ..... 343/702
7,365,683 B2 * 4/2008 Park ..... 343/700 MS
7,420,511 B2 * 9/2008 Oshiyama et al. ..... 343/700 MS (Continued)

FOREIGN PATENT DOCUMENTS

EP 1 453 139 A1 9/2004

(Continued)

OTHER PUBLICATIONS

International Search Report of International Application No. PCT/JP2007/062891.

(Continued)

*Primary Examiner* — Tho G Phan
(74) *Attorney, Agent, or Firm* — Keating & Bennett, LLP

(57) ABSTRACT

An antenna device capable of not only achieving multiple resonances and wideband characteristics but also achieving improvement of antenna efficiency and accurate matching at all resonant frequencies, and a wireless communication apparatus. In one example, an antenna device 1 includes a radiation electrode 2 to which power is capacitively fed through a capacitor portion C1, and additional radiation electrodes 3-1 to 3-3 branched from the radiation electrode 2. A distal end portion 2*a* of the radiation electrode 2 is grounded to a ground region 402, and is a portion at which a minimum voltage is obtained when power is fed. A capacitor portion C2 that is a portion at which a maximum voltage is obtained when power is fed is disposed in a proximal end portion 2*b* of the radiation electrode 2, and a variable capacitance element 4 which is grounded is connected in series with the capacitor portion C2. The additional radiation electrodes 3-1 to 3-3 are connected to the radiation electrode 2 through switch elements 31 to 33, and include reactance circuits 5-1 to 5-3 in a middle thereof. Distal end portions of the additional radiation electrodes 3-1 to 3-3 are grounded to the ground region 402.

11 Claims, 12 Drawing Sheets

U.S. PATENT DOCUMENTS

| | | | | |
|---|---|---|---|---|
| 7,830,330 | B2 * | 11/2010 | Pelzer | 343/876 |
| 7,952,525 | B2 * | 5/2011 | Hirabayashi | 343/700 MS |
| 2004/0145525 | A1 | 7/2004 | Annabi et al. | |
| 2006/0017621 | A1 * | 1/2006 | Okawara et al. | 343/700 MS |
| 2006/0097918 | A1 * | 5/2006 | Oshiyama et al. | 343/700 MS |

FOREIGN PATENT DOCUMENTS

| | | | |
|---|---|---|---|
| JP | 06-224618 | A | 8/1994 |
| JP | 2002-261533 | | 9/2002 |
| JP | 2002-335117 | | 11/2002 |
| JP | 2003-60417 | | 2/2003 |
| JP | 2004-253943 | | 9/2004 |
| JP | 2005-210568 | | 8/2005 |
| JP | 2005-269608 | | 9/2005 |
| WO | WO 2004/047223 | | 6/2004 |

OTHER PUBLICATIONS

Written Opinion with English language translation of International Application No. PCT/JP2007/062891.

Official Communication issued in corresponding Japanese Patent Application No. 2007-556454, mailed on Jul. 14, 2010.

Official communication issued in counterpart European Application No. 07 76 7693, dated on Jul. 8, 2009.

* cited by examiner

Prior Art

ANTENNA DEVICE AND WIRELESS COMMUNICATION APPARATUS

CROSS-REFERENCE TO RELATED APPLICATIONS

The present application is a continuation of PCT/JP2007/062891, filed 27 Jun. 2007, which claims priority of Japanese Application No. 2006-206983, filed 28 Jul. 2006, both incorporated by reference herein. The PCT International Application was published in the Japanese language.

BACKGROUND

1. Technical Field

An antenna device for use in a compact mobile telephone or the like and capable of multiple-resonance wideband transmission and reception, and to a wireless communication apparatus.

2. Background Art

In the related art, antenna devices of this type include the antenna devices shown in FIGS. 19 to 21.

FIG. 19 is a plan view showing a multiple-resonance antenna device of the related art, FIG. 20 is a plan view of a wideband antenna device of the related art, and FIG. 21 is a plan view showing a multiple-resonance wideband antenna device of the related art.

First, the antenna device 100 shown in FIG. 19 is an inverted-F-shaped antenna device as disclosed in Patent Document 1. The antenna device 100 has a structure in which a plurality of additional radiation electrodes 111 to 113 which are grounded are connected to a radiation electrode 101 through switches 121 to 123.

The antenna device 100 is therefore an antenna device in which a plurality of resonant frequencies can be selected by switching the switches 121 to 123 to achieve multiple resonances.

Next, the antenna device 200 shown in FIG. 20 is an inverted-F-shaped antenna device as disclosed in either Patent Document 2 or 3. The antenna device 200 has a structure in which an additional radiation electrode 210 is branched from a radiation electrode 201 and in which a variable capacitance element 211 is connected to a distal end of the additional radiation electrode 210 and is grounded.

The antenna device 200 is therefore an antenna device in which a resonant frequency can be shifted by changing an impedance of the variable capacitance element 211 to achieve a wide resonant frequency band.

Finally, the antenna device 300 shown in FIG. 21 is an antenna device as disclosed in Patent Document 4. The antenna device 300 has a structure in which a plurality of additional radiation electrodes 311 and 312 which are grounded are connected through switches 321 and 322 to a radiation electrode 301 whose distal end is grounded and in which variable capacitance elements 331 (and 332) are provided in the additional radiation electrode 311 (and 312).

The antenna device 300 is therefore an antenna device in which a plurality of resonant frequencies can be selected by switching the switches 321 and 322 to achieve multiple resonances and in which resonant frequencies can be shifted by changing impedances of the variable capacitance elements 331 (and 332) to increase the bandwidth of the resonant frequencies.

Patent Document 1: Japanese Unexamined Patent Application Publication No. 2002-261533

Patent Document 2: Japanese Unexamined Patent Application Publication No. 2005-210568

Patent Document 3: Japanese Unexamined Patent Application Publication No. 2002-335117

Patent Document 4: International Publication No. WO 2004/047223

However, the antenna devices of the related art described above have the following problems.

The antenna device 100 shown in FIG. 19 suffers from significant degradation of antenna gain.

In general, in compact antenna devices, the use of a lower resonant frequency decreases antenna gain, resulting in degradation of antenna efficiency. The antenna device 100 shown in FIG. 19 is configured to obtain the lowest resonant frequency by turning on the switch 123. In such a situation, loss due to the switching operation reduces antenna gain, resulting in further degradation of antenna efficiency.

In the antenna device 100, further, a current flows to the additional radiation electrode corresponding to the switch that is the closest to a feed unit the among switches that are in the on state. For example, even when all the additional radiation electrodes 111 to 113 are turned on, a current flows only in the switch 121, which is the closest to a feed unit 400, and no current flows in the switch 122 or 123. Further, only a number of resonant frequencies corresponding to the number of switches 121 to 123 are generated, so that the number of resonant frequencies is small.

The antenna device 200 shown in FIG. 20 also suffers from degradation of antenna efficiency.

In the antenna device 200, since only the variable capacitance element 211 is grounded, the minimum voltage is at the variable capacitance element 211 and a maximum current flows in the variable capacitance element 211. Power consumption at the variable capacitance element 211 becomes large, resulting in great degradation of antenna efficiency.

In the antenna device 300 shown in FIG. 21, it is difficult to reduce the antenna size.

In the antenna device 300, a maximum voltage is generated on the radiation electrode 301, which is parallel to a ground region 402, but is not generated near the feed unit 400. A minimum voltage is generated at the distal end of the radiation electrode 301. Thus, the antenna device 300 operates only at an antenna length equal to a half wavelength but does not operate at an antenna length equal to a quarter wavelength. The radiation electrode 301 is therefore long, and a reduction in antenna size is not achieved.

In the antenna device 300, further, it is difficult to match impedance between the feed unit side and the antenna side at all frequencies.

The impedance of the antenna device 300 is determined by taking stray capacitance generated between the radiation electrode 301 and the ground region 402 into account. The switching operation of the switches 321 and 322 causes a change in a maximum electric field position each time the switching operation is performed. Thus, the capacitance component of the impedance greatly varies depending on antenna installation conditions. As a consequence, depending on the switching state of the switches 321 and 322, matching between the feed unit 400 side and the antenna is or is not achieved, and accurate matching at all resonant frequencies is not achieved.

SUMMARY

The disclosed antenna device solves the foregoing problems, and provides an antenna device capable of not only achieving multiple resonances and wideband characteristics but also achieving improvement of antenna efficiency and accurate matching at all resonant frequencies, and a wireless communication apparatus.

To solve the above problems, the advantageously may provide an antenna device including a radiation electrode having a proximal end portion through which power is capacitively fed and a distal end portion grounded, and a plurality of additional radiation electrodes, each additional radiation electrode being branched from the radiation electrode through a switch element and having a distal end portion grounded, wherein the proximal end portion of the radiation electrode is provided with a capacitor portion that includes opposing electrode portions and that is a portion at which a maximum voltage is obtained when power is fed, and a variable capacitance element is connected to the capacitor portion and is grounded, and wherein a reactance circuit is provided in each of the additional radiation electrodes.

With this structure, when all the switch elements are turned off, the plurality of additional radiation electrodes is electrically separated from the radiation electrode. Then only the radiation electrode operates, and the antenna device resonates at the lowest frequency. The antenna gain tends to decrease at such a low frequency. However, unlike the antenna device shown in FIG. 19, since the switch elements are in the off state, no power loss due to a switching operation occurs.

Further, the antenna device can achieve a number of antenna configurations corresponding to $2^n$, where n is to the ordinal number of switch elements, depending on the on and off states of the switch elements. In the antenna device shown in FIG. 19, as described above, even if such a large number of antenna configurations are achievable, the number of resonant frequencies is restricted to the number of switch elements. In the disclosed antenna device, on the other hand, a reactance circuit is provided in each of the additional radiation electrodes and thus an impedance is generated in each of the additional radiation electrodes. When a switch element is turned on, a current flows in the additional radiation electrode branched through the switch element. That is, unlike the antenna device shown in FIG. 19, a current flows through all additional radiation electrodes connected to the switch element that is in the on state. As a consequence, the antenna device can resonate at a number of resonant frequencies corresponding to $2^n$, where n is the ordinal number of switch elements. By changing the capacitance of the variable capacitance element connected to the capacitor portion, resonant frequencies for each antenna configuration can be continuously changed.

Further, since the grounded variable capacitance element is connected to the capacitor portion at which a maximum voltage is obtained, a current flowing in the variable capacitance element is minimum. Therefore, unlike the antenna device shown in FIG. 20, the power consumed by the variable capacitance element is significantly small.

Further, since the distal end portion of the radiation electrode is grounded, the minimum voltage is at the distal end portion of the radiation electrode when power is fed. Furthermore, the capacitor portion at which a maximum voltage is obtained when power is fed is provided in the proximal end portion of the radiation electrode, which is the most distant from the distal end portion of the radiation electrode. Thus, the maximum voltage is at the proximal end portion. That is, unlike the antenna device shown in FIG. 21, the antenna device operates at an antenna length equal to one quarter of the wavelength at a resonant frequency.

Further, since a maximum voltage is generated at the capacitor portion that is provided in the proximal end portion of the radiation electrode, the capacitance value of the capacitor portion is significantly high and fixed. Therefore, capacitance generated between the radiation electrode and the ground is not substantially changed by the switching of the switch elements, resulting in substantially no change in the capacitance component of the impedance of the antenna device, unlike the antenna device shown in FIG. 21.

In the disclosed antenna device, at least one reactance circuit, of the reactance circuits provided in the plurality of additional radiation electrodes, may include a capacitor.

With this structure, when a switch element of an additional radiation electrode provided with a reactance circuit including a capacitor is turned on, an inductor of an additional radiation electrode that operates near the capacitor and the capacitor constitute a parallel resonant circuit. The parallel resonant circuit functions as a band stop filter. Therefore, two resonant frequencies, namely, a resonant frequency at which the parallel resonant circuit functions as a band stop filter and a resonant frequency at which the parallel resonant circuit does not function as a band stop filter, can be obtained with one antenna configuration.

In the disclosed antenna device, at least one reactance circuit, of the reactance circuits provided in the plurality of additional radiation electrodes, may include a variable capacitance element.

With this structure, the capacitance of a variable capacitance element of a reactance circuit provided in an additional radiation electrode is changed, whereby resonant frequencies for an antenna configuration achieved by the additional radiation electrodes can be continuously changed.

In the disclosed antenna device, at least one reactance circuit, of the reactance circuits provided in the plurality of additional radiation electrodes, may be a series resonant circuit or a parallel resonant circuit.

With this structure, a reactance value of the series resonant circuit or parallel resonant circuit is set, whereby a desired resonant frequency can be obtained. In particular, the parallel resonant circuit can be used as a band stop filter, and therefore two resonant frequencies can be obtained with one antenna configuration.

In the disclosed antenna device, the variable capacitance element may be connected in series or in parallel with the capacitor portion, or a parallel resonant circuit including the variable capacitance element may be connected in series with the capacitor portion.

With this structure, the capacitance of the variable capacitance element may be changed, whereby resonant frequencies for each antenna configuration can be continuously changed. A deviation between the resonant frequencies is the smallest when the variable capacitance element is connected in parallel with the capacitor portion, and increases in the order of the case where the variable capacitance element is connected in series with the capacitor portion and the case where a parallel resonant circuit including the variable capacitance element is connected in series with the capacitor portion.

In the disclosed antenna device, the radiation electrode and the plurality of additional radiation electrodes may be patterned on a dielectric substrate.

With this structure, the capacitance value of the capacitor portion, the capacitance values between the radiation electrode and the additional radiation electrodes, the capacitance values between the additional radiation electrodes, etc., can be increased by the dielectric substrate.

In another embodiment, a wireless communication apparatus includes the antenna device described above, and an appropriate feed unit for carrying on wireless communications.

As described in detail above, the antenna device resonates at a low-frequency when switch elements are in the off state. No power loss occurs due to a switching operation, and antenna gain can therefore be increased to improve antenna efficiency.

Further, the antenna device can obtain a number of resonant frequencies as large as $2^n$, where n is the ordinal number of switch elements, and therefore sufficiently supports reception of multi-channel broadcast such as digital broadcast television. The capacitance of the variable capacitance element is changed to thereby continuously changing resonant frequencies for each antenna configuration. Therefore, the bandwidth of resonant frequencies can be increased.

Further, the power consumed by the grounded variable capacitance element is significantly small. Therefore, antenna efficiency can also be improved.

Further, the antenna device operates at a quarter wavelength. Therefore, the length of electrodes such as the radiation electrode can be reduced correspondingly, resulting in a reduction in antenna size.

Further, the current distribution of the antenna device is not substantially changed due to the switching of the switch elements. Therefore, accurate matching with the feeder side at all resonant frequencies can be performed.

According to the antenna device according, two resonant frequencies can be obtained in one antenna configuration. Therefore, more multiple resonances can be achieved.

Furthermore, according to the antenna device, resonant frequencies can be continuously changed by changing the capacitance of the variable capacitance element of the reactance circuit. Therefore, the bandwidth can be increased accordingly.

Furthermore, according to the antenna device, a frequency bandwidth can be increased and more multiple resonances can be achieved.

Furthermore, according to the antenna device, in addition to an increase in the bandwidth of resonant frequencies, any of a parallel connection between a variable capacitance element and a capacitor portion, a series connection between a variable capacitance element and a capacitor portion, and a series connection between a parallel resonant circuit including a variable capacitance element and a capacitor portion can be selected, whereby a deviation between the resonant frequencies can be adjusted to a desired value.

According to the antenna device, the capacitance value of the capacitor portion, the capacitance values between the radiation electrode and the additional radiation electrodes, the capacitance values between the additional radiation electrodes, etc., can be increased. Therefore, a long antenna length can be obtained using a short electrode, resulting in a reduction in the size of the antenna device.

Furthermore, according to the wireless communication apparatus, it is possible to achieve multiple-resonance wideband transmission and reception, and it is also possible to achieve high-antenna-efficiency high-operation-performance communication.

Other features and advantages will become apparent from the following description which refers to the accompanying drawings.

DETAILED DESCRIPTION

Reference Numerals

Figure 1:
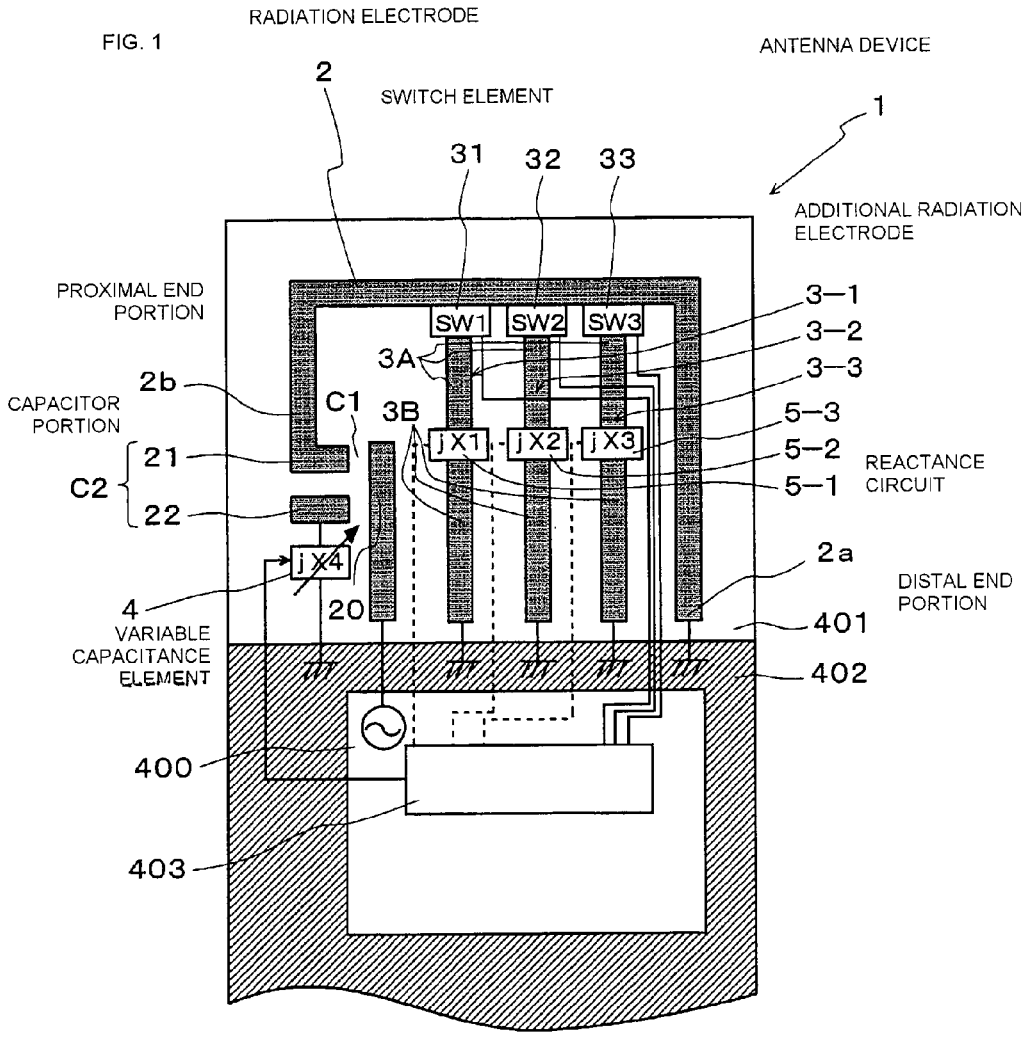
FIG. 1 is a plan view showing an antenna device according to a first embodiment.

1 antenna device
2 radiation electrode
2*a* distal end portion
2*b* proximal end portion
3-1 to 3-3 additional radiation electrode
3A, 3B, 21, 22 electrode portion
4 variable capacitance element
5-1 to 5-3 reactance circuit
6 dielectric substrate
20 feed electrode
31 to 33 switch element
34, 52 capacitor
35, 42, 54 resistor
40, 50 parallel resonant circuit
41, 53 varicap
43, 51 inductor
44 pattern
60 front surface
61 top surface
400 feed unit
401 non-ground region
402 ground region
403 control IC

403*a*, 403*b*, 403*c* line

C1, C2 capacitor portion

Vb, Vc dc control voltage d1 deviation f1 to f8, f1', f2' resonant frequency Embodiments will now be described with reference to the drawings.

First Embodiment

FIG. 1 is a plan view showing an antenna device according to a first embodiment.

An antenna device 1 of this embodiment is mounted in a wireless communication apparatus such as a mobile telephone or a PC card.

As shown in FIG. 1, the antenna device 1 is disposed in a non-ground region 401 on a circuit board of the wireless communication apparatus, and exchanges a high-frequency signal with a transmission/reception unit 400 serving as a feed unit mounted in a ground region 402.

The antenna device 1 includes a radiation electrode 2, and a plurality of additional radiation electrodes 3-1 to 3-3 branched from the radiation electrode 2.

The radiation electrode 2 is a conductive pattern that is bent into a right-angled U-shape. A distal end portion 2*a* of the radiation electrode 2 is grounded to the ground region 402.

High-frequency power is capacitively fed from the feed unit 400 to the radiation electrode 2. Specifically, a horizontal electrode portion 21 is provided in a proximal end portion 2*b* of the radiation electrode 2, and the electrode portion 21 faces a feed electrode 20 connected to the feed unit 400 to define a capacitor portion C1.

A capacitor portion C2 is also disposed in the proximal end portion 2*b* of the radiation electrode 2. Specifically, an electrode portion 22 is arranged so as to face the electrode portion 21 to define the capacitor portion C2, and a variable capacitance element 4 is connected in series after the capacitor portion C2 and is grounded.

Here, the capacitor portion C2 is set to be a portion at which a maximum voltage is obtained when power is fed from the feed unit 400 to the radiation electrode 2, and has a significantly large capacitance value.

The variable capacitance element 4 may be implemented by a varicap, a MEMS (Micro-Electro-Mechanical Systems) element, or another suitable capacitance element. A ferroelectric filler may be disposed in a fixed capacitor and a voltage applied to the ferroelectric filler, whereby the capacitance of the capacitor can be changed. Such a capacitor can therefore be used as the variable capacitance element 4. The capacitance of the variable capacitance element 4 is controlled by a dc control voltage from a control IC 403.

The additional radiation electrodes 3-1 to 3-3 are connected to the radiation electrode 2 through switch elements 31 to 33. The additional radiation electrodes 3-1 to 3-3 are electrically connected to the radiation electrode 2 in the on state of the switch elements 31 to 33, and are electrically separated from the radiation electrode 2 in the off state of the switch elements 31 to 33.

Each switch element 31 to 33 may be implemented by a Schottky diode, PIN diode, MEMS, FET (Field Effect Transistor), SPDT (Single Pole Double Throw), or the like. The switching operation of the switch elements 31 to 33 is controlled by a dc control voltage from the control IC 403.

The additional radiation electrodes 3-1 (3-2 and 3-3) are further provided with reactance circuits 5-1 (5-2 and 5-3). Each of the additional radiation electrodes 3-1 (3-2 and 3-3) includes an electrode portion 3A, which is near the radiation electrode 2, and an electrode portion 3B, which is near the ground region 402, and each of the reactance circuits 5-1 (5-2 and 5-3) is connected between and separates the corresponding electrode portions 3A and 3B. A distal end portion of the electrode portion 3B of each of the additional radiation electrodes 3-1 (3-2 and 3-3) is grounded to the ground region 402.

As described below, the reactance circuits 5-1 (5-2 and 5-3) may be implemented by fixed or variable capacitors, inductors, series resonant circuits, parallel resonant circuits, or the like. In a case where the reactance circuits 5-1 (5-2 and 5-3) include variable capacitance elements such as varicaps, as indicated by broken lines, the capacitance of the variable capacitance elements can be changed by a dc control voltage from the control IC 403 to thereby change the reactance values of the reactance circuits 5-1 (5-2 and 5-3).

Next, the operation and advantages of the antenna device of this embodiment will be described.

Figure 2:
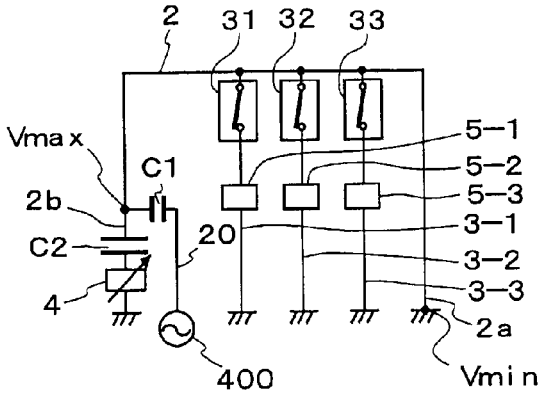
FIG. 2 is a schematic view of the antenna device of this embodiment.

FIG. 2 is a schematic view of the antenna device 1 of this embodiment.

Figure 21:
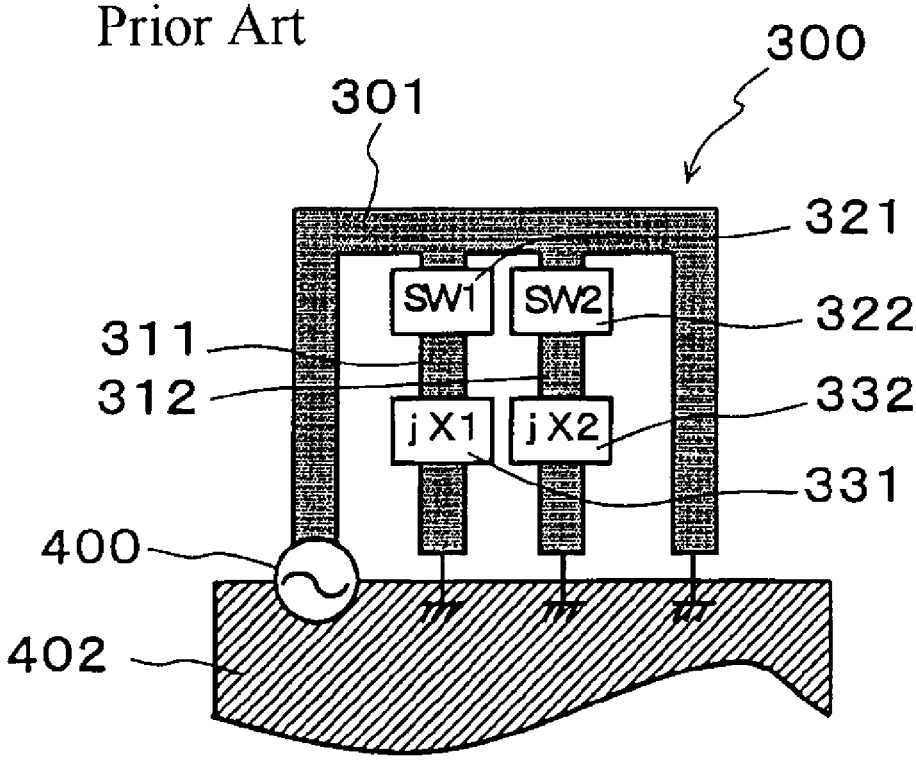
Fig. 21 Prior Art
FIG. 21 is a plan view of a multi-resonance wideband antenna device of the related art.

When power is fed from the feed unit 400 shown in FIG. 2 to the feed electrode 20, the power is fed to the radiation electrode 2 through the capacitor portion C1. In a resonance state, a minimum voltage Vmin exists at the grounded distal end portion 2*a* of the radiation electrode 2 and a maximum voltage Vmax exists at the capacitor portion C2 in the proximal end portion 2*b*. That is, the voltage becomes the maximum Vmax at the capacitor portion C2, decreasing toward the distal end portion 2*a* of the radiation electrode 2, and becomes the minimum Vmin at the grounded distal end portion 2*a*. Therefore, unlike the antenna device of the related art shown in FIG. 21, the antenna device 1 operates at an antenna length equal to one quarter of the wavelength at a resonant frequency. Therefore, the length of the radiation electrode 2 and the like can be reduced compared with the antenna device of the related art shown in FIG. 21, and the antenna size can be reduced.

Figure 3:
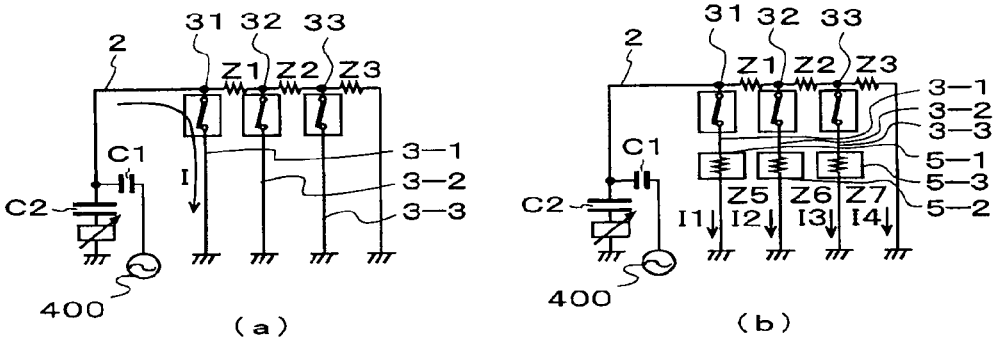
Prior Art FIG. 3
FIGS. 3(*a*) and (*b*) are schematic views showing respective states in which a current flows into additional radiation electrodes.

FIG. 3 is a schematic view showing a state where a current flows in additional radiation electrodes.

Figure 19:
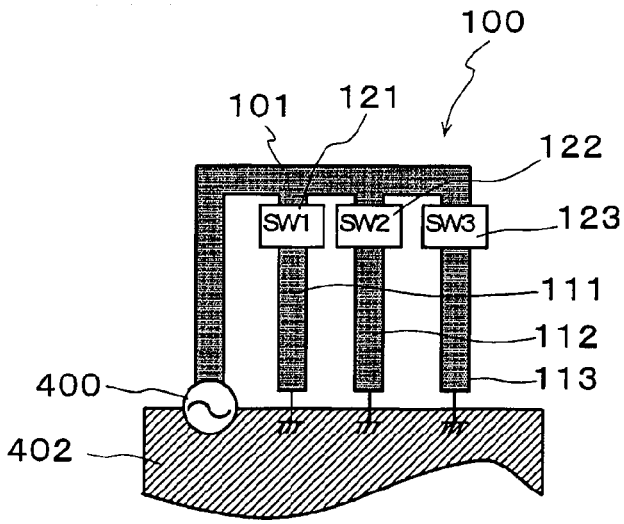
FIG. 19 is a plan view showing a multi-resonance antenna device of the related art.
Figure 20:
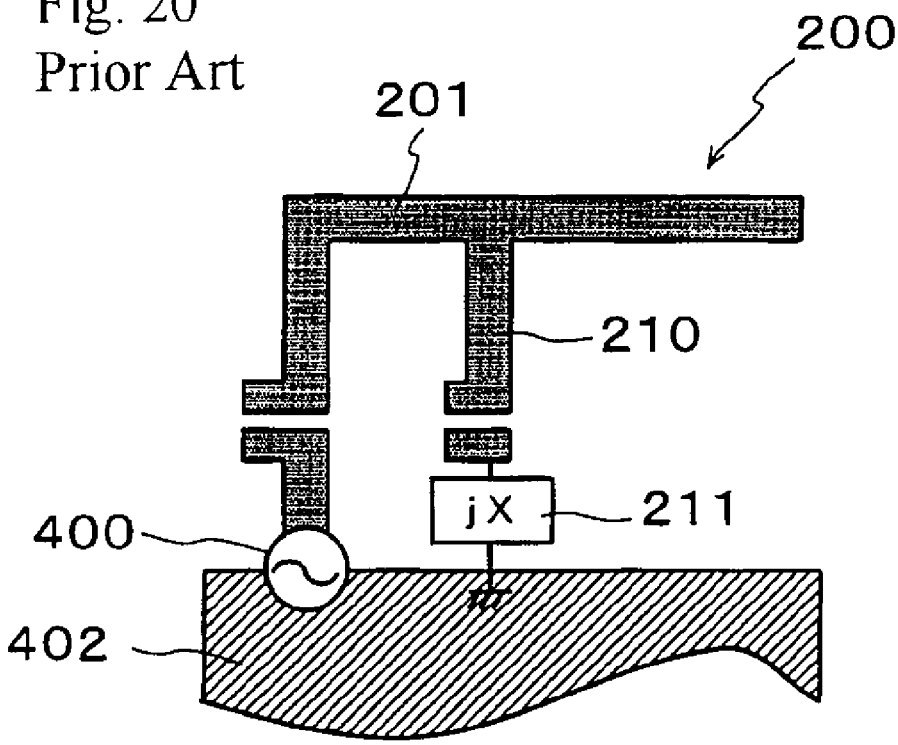
Fig. 20 Prior Art
FIG. 20 is a plan view of a wideband antenna device of the related art.

FIG. 3(*a*) shows an antenna device that is similar to the antenna device shown in FIG. 19, in which the additional radiation electrodes 3-1 (3-2 and 3-3) are not provided with the reactance circuits 5-1 (5-2 and 5-3). In such an antenna device, although impedances Z1 to Z3 are generated in the radiation electrode 2, no impedance is generated in the additional radiation electrodes 3-1 (3-2 and 3-3). Thus, when the switch element 31 is turned on, a current I flows in the additional radiation electrode 3-1 with zero impedance regardless of whether or not the switch elements 32 and 33 are in the on state. In the structure shown in FIG. 3(*a*), therefore, although it is possible to obtain eight antenna configurations, only a number of resonant frequencies corresponding to the number of switch elements 31 to 33, i.e., "three", are obtained.

In the antenna device 1 of this embodiment shown in FIG. 3(*b*), on the other hand, since the additional radiation electrode 3-1 (or 3-2 or 3-3) is provided with the reactance circuit 5-1, impedances Z5 to Z7 are generated in the additional radiation electrodes 3-1 to 3-3 due to the reactance circuits 5-1 to 5-3 in addition to the impedances Z1 to Z3 of the radiation electrode 2. Thus, when the switch element 31 is in the on state, a current flows or does not flow in the switch elements 32 and 33 depending on whether the switch elements 32 and 33 are in the on or off state. That is, currents I1 to I3 corresponding to the impedances of the switch elements 31 to 33 that are in the on state flow in the additional radiation electrodes 3-1 to 3-3 through the switch elements 31 to 33 that are in the on state, and a current I4 flows toward the distal end portion side of the radiation electrode 2. In the structure shown in FIG. 3(*b*), therefore, a number of resonant frequencies equal to the eight antenna configurations can be obtained.

In the antenna device 1 of this embodiment, accordingly, a larger number of resonant frequencies than that of the antenna device shown in FIG. 19 can be obtained.

Figure 4:
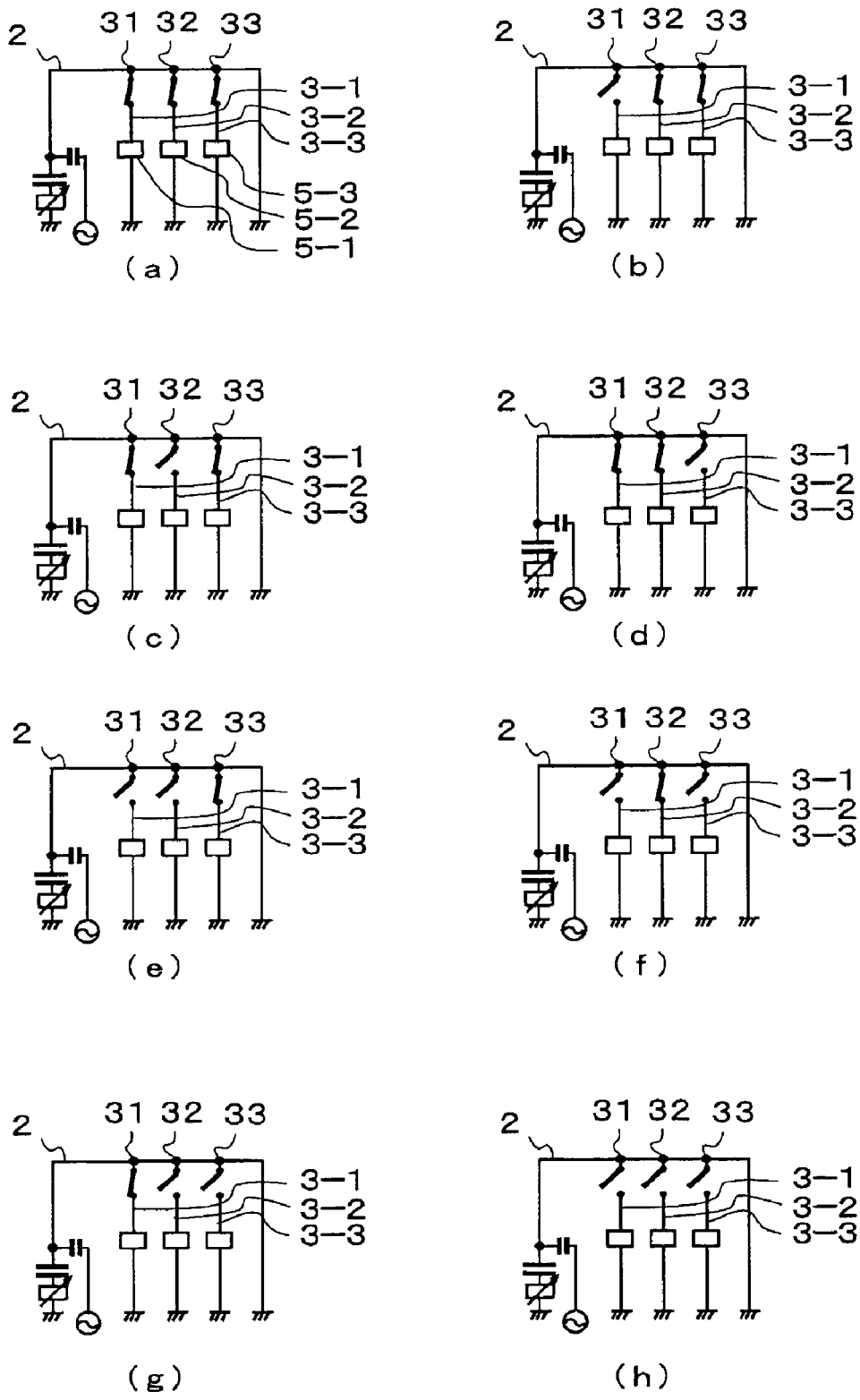
FIGS. 4(*a*)-(*h*) are respective schematic views showing various antenna configurations.

FIG. 4 is a schematic view showing antenna configurations.

In FIG. 2, when power is fed from the feed unit 400, resonance occurs in each antenna configuration depending on the on and off states of the switch elements 31 to 33. An antenna configuration is implemented by turning on and off the switch elements 31 to 33, and there exist a number of configurations equal to $2^n$, where n is the ordinal number of switch elements. In this embodiment, since the number of switch elements is three, a number of antenna configurations equal to $2^n$, where n is the ordinal number of switch elements, i.e., eight antenna configurations as shown in FIGS. 4(*a*)-(*h*), can be obtained.

Figure 5:
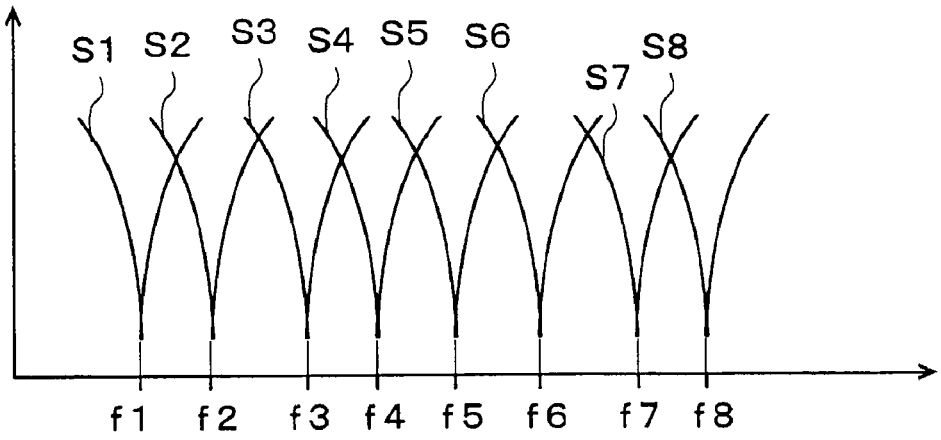
FIG. 5 is a diagram showing return loss curves at resonant frequencies in the eight antenna configurations shown in FIG. 4.

FIG. 5 is a diagram showing return loss curves at resonant frequencies in the eight antenna configurations shown in FIGS. 4(*a*)-(*h*).

In the antenna configurations shown in FIGS. 4(*a*)-(*h*), a resonant frequency f8 obtained in the case where, as shown in FIG. 4(*a*), all the switch elements 31 to 33 are in the on state is the highest. As shown in FIGS. 4(*b*)-(*g*), one or more of the switch elements 31 to 33 are turned off, thereby decreasing resonant frequencies in the order of resonant frequencies f7 to f2. A resonant frequency f1 obtained in the case where all the switch elements 31 to 33 are in the off state is the lowest.

Therefore, as indicated by the return loss curves S1 to S8 shown in FIG. 5, the antenna device 1 provides transmission and reception using the eight different resonant frequencies f1 to f8.

The transmission and reception at the lowest resonant frequency f1 involves an antenna gain problem, as in the antenna device shown in FIG. 19. In this embodiment, however, as shown in FIG. 4(*h*), the resonant frequency f1 is obtained by turning off all the switch elements 31 to 33. Thus, unlike the antenna device shown in FIG. 19, no degradation of antenna gain due to a switching operation occurs.

Figure 6:
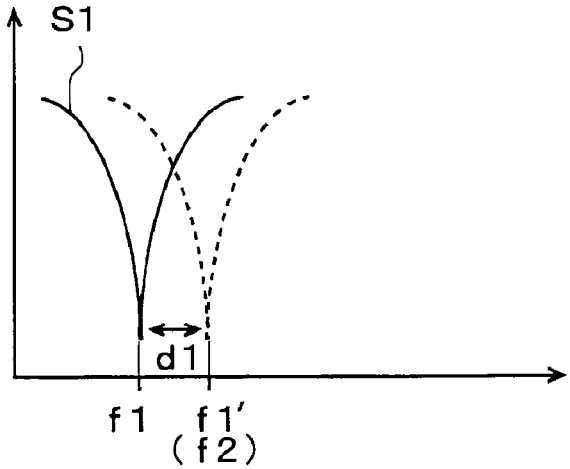
FIG. 6 is a diagram showing a shift of a return loss curve caused by a change in resonant frequency.

FIG. 6 is a diagram showing a shift of a return loss curve caused by a change in resonant frequency.

In the structure shown in FIG. 1, the capacitance value of the variable capacitance element 4 can be changed by inputting a dc control voltage from the control IC 403 to the variable capacitance element 4. For example, as shown in FIG. 6, in the resonance state at the resonant frequency f1, the capacitance value of the variable capacitance element 4 can be continuously changed, whereby the resonant frequency f1 can be shifted to a resonant frequency f1' by a deviation d1. A shift of the resonant frequency f1 to an adjacent resonant frequency f2 allows transmission and reception within a range of the resonant frequencies f1 to f2. That is, although the eight resonant frequencies f1 to f8 shown in FIG. 5 are discrete, the capacitance of the variable capacitance element 4 can be changed in each antenna configuration, thereby achieving a wide frequency band while filling in gaps between the resonant frequencies f1 to f8.

Since the variable capacitance element 4 having the above function is grounded, a large current flows in the variable capacitance element 4 and excessive power consumption may occur. In this embodiment, however, as shown in FIGS. 1 and 2, the variable capacitance element 4 is connected close to the capacitor portion C2, which is a portion at which a maximum voltage is obtained. Thus, the voltage also becomes large at the variable capacitance element 4, and a current flowing in the variable capacitance element 4 is significantly reduced. As a result, the power consumed by the variable capacitance element 4 is significantly reduced.

In the antenna device 1 of this embodiment, further, the capacitor portion C2 is set to be a portion at which a maximum voltage is obtained when power is fed from the feed unit 400 to the radiation electrode 2, and the capacitance value of the capacitor portion C2 is set significantly large. Therefore, even if a change in stray capacitance occurs due to the switching of the switch elements 31 to 33, the capacitance component of the overall impedance of the antenna device 1 largely depends on the capacitor portion C2, and no change occurs in the current distribution. This results in accurate matching with the feed unit 400 side at all resonant frequencies.

Second Embodiment

Next, a second embodiment will be described.

Figure 7:
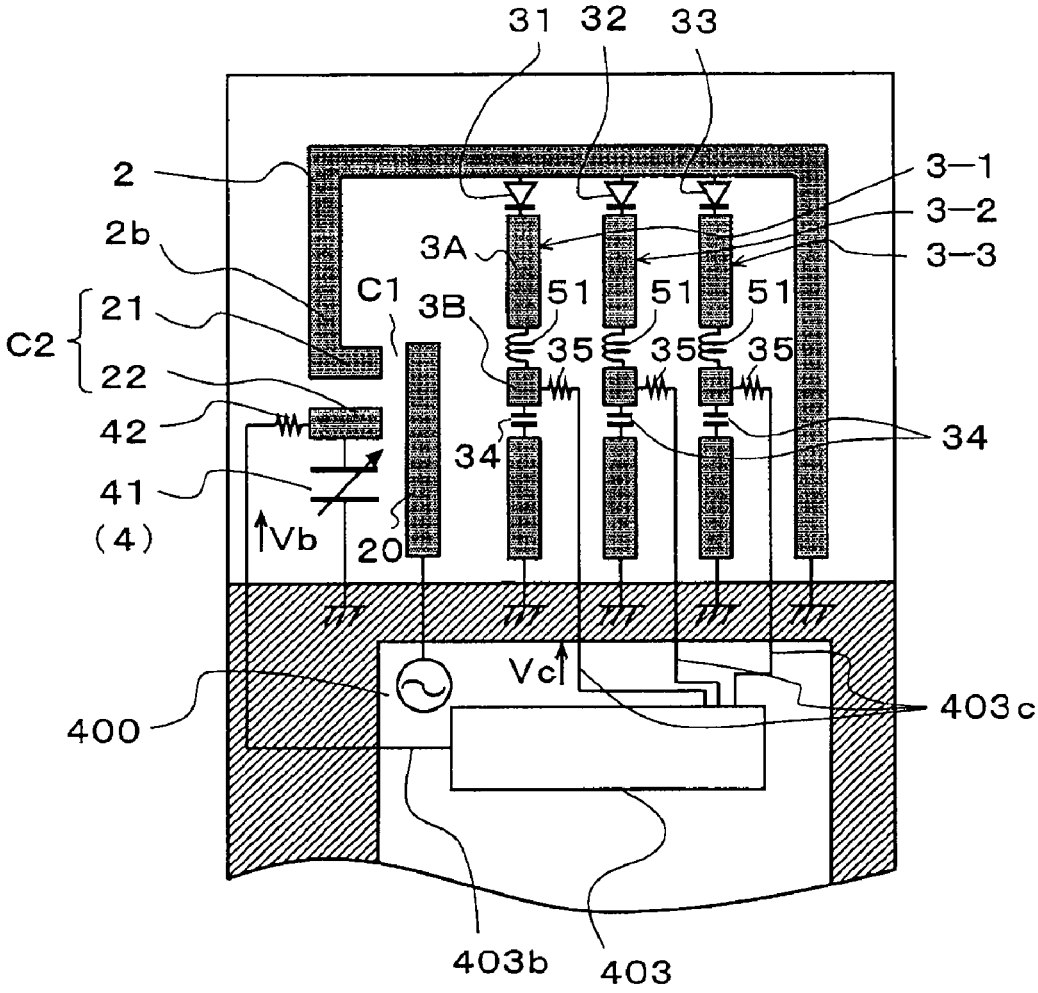
FIG. 7 is a plan view showing an antenna device according to a second embodiment.

FIG. 7 is a plan view showing an antenna device according to the second embodiment.

In the antenna device of this embodiment, the switch elements 31 to 33, the reactance circuits 5-1 to 5-3, and the variable capacitance element 4 of the first embodiment are implemented by specific elements.

As shown in FIG. 7, the switch elements 31 to 33 are implemented by Schottky diodes 31 to 33. Anodes of the Schottky diodes 31 (32 and 33) are connected to the radiation electrode 2 and cathodes thereof are connected to the electrode portions 3A of the additional radiation electrodes 3-1 (3-2 and 3-3).

The variable capacitance element 4 is implemented by a varicap 41. A cathode of the varicap 41 is connected to the electrode portion 22 and an anode thereof is grounded.

The reactance circuits 5-1 to 5-3 are implemented by inductors 51, and both ends of each of the inductors 51 are connected to the electrode portions 3A and 3B of each of the additional radiation electrodes 3-1 (3-2 and 3-3).

The on-off operation of the Schottky diodes 31 (32 and 33) is controlled by a dc control voltage Vc from the control IC 403. Specifically, lines 403*a* are connected to the electrode portions 3B of the additional radiation electrodes 3-1 (3-2 and 3-3) through resistors 35 (e.g., 100 kΩ), and the dc control voltage Vc is applied to the cathode side of the Schottky diodes 31 (32 and 33) through the lines 403*c*. Thus, for example, the dc control voltage Vc of 2 (V) is applied to turn on the Schottky diodes 31 (32 and 33), and the dc control voltage Vc of 0 (V) is applied to turn off the Schottky diodes 31 (32 and 33). The electrode portions 3B of the additional radiation electrodes 3-1 (3-2 and 3-3) are provided with capacitors 34 (e.g., 1000 (pF)) to prevent the dc control voltage Vc from flowing to the ground region 402.

The capacitance of the varicap 41 is adjusted by a dc control voltage Vb from the control IC 403. Specifically, a line 403*b* is connected to the electrode portion 22 of the capacitor portion C2 through a resistor 42 (e.g., 100 kΩ), and the dc control voltage Vb is applied to the cathode side of the varicap 41 through the line 403*b*. Thus, for example, the dc control voltage Vb in a range of 0 (V) to 3 (V) is applied to continuously change the capacitance of the varicap 41. The resistor 42 provided on the line 403*b* is an element for preventing a high frequency for each resonance from flowing to the control IC 403 through the line 403*b*.

Each of the inductors 51 may be not only a chip component but also may be a meander line or the like that is patterned between the electrode portions 3A and 3B.

The inductors 51 of the additional radiation electrodes 3-1 to 3-3 are set so as to have the same inductance value or different inductance values, thereby changing as desired a resonant frequency for each antenna configuration generated by the switching of the Schottky diodes 31 to 33.

The resistors 35 provided on the lines 403*c* are elements for preventing a high frequency for each resonance from flowing to the control IC 403 through the lines 403*c*.

With the above structure, the dc control voltage Vc of 0 (V) or 2 (V) from the control IC 403 is input to the additional radiation electrodes 3-1 to 3-3 to switch the Schottky diodes 31 to 33. Thus, eight resonant frequencies f1 to f8 (see FIG. 5) corresponding to the inductance values of the inductors 51 can be obtained.

The dc control voltage Vb of 0 (V) to 3 (V) from the control IC 403 is input to the electrode portion 22 to continuously change the capacitance value of the varicap 41. Thus, a resonant frequency for each antenna configuration can be shifted (see FIG. 6).

The remaining structure, operation, and advantages are similar to those of the first embodiment, and a description thereof is thus omitted.

Third Embodiment

Next, a third embodiment will be described.

Figure 8:
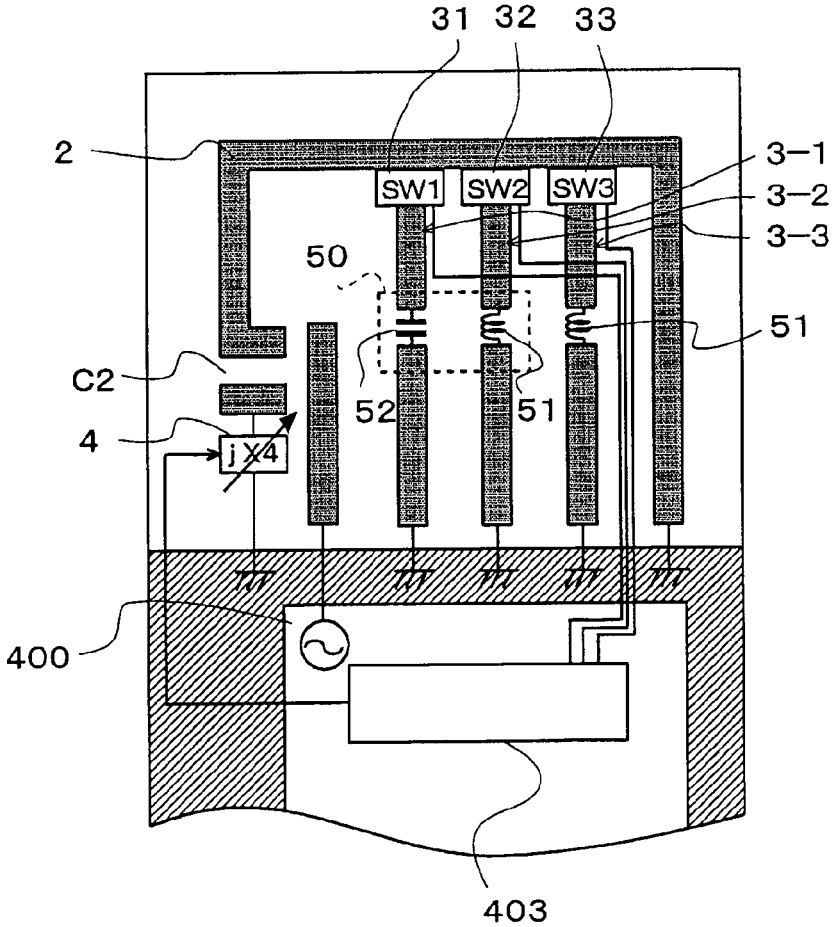
FIG. 8 is a plan view showing an antenna device according to a third embodiment.
Figure 9:
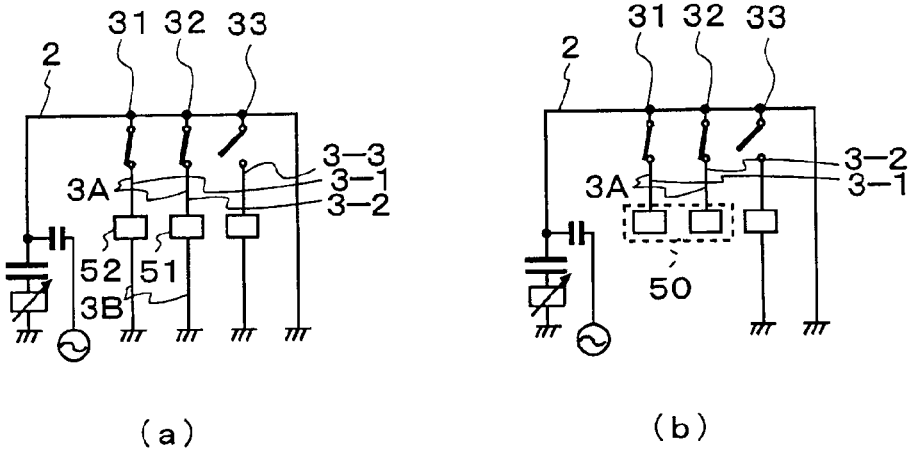
FIGS. 9(*a*) and (*b*) are schematic views showing two respective resonance states.
Figure 10:
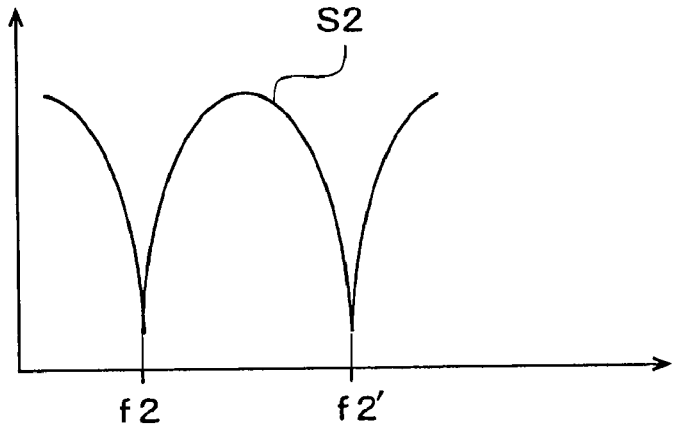
FIG. 10 is a diagram showing a return loss curve obtained by two resonant frequencies.

FIG. 8 is a plan view showing an antenna device according to the third embodiment, FIG. 9 is a schematic view showing two resonance states, and FIG. 10 is a diagram showing a return loss curve obtained by two resonant frequencies.

The antenna device of this embodiment is different from the antenna devices of the first and second embodiments in that at least one reactance circuit of the reactance circuits 5-1 to 5-3 of the additional radiation electrodes 3-1 to 3-3 is formed of a capacitor.

Specifically, as shown in FIG. 8, the reactance circuit 5-1 is formed of a capacitor 52, and each of the reactance circuits 5-2 and 5-3 is formed of an inductor 51.

With this structure, when the switch element 31 of the additional radiation electrode 3-1 provided with the capacitor 52 is turned on, the inductors 51 of the additional radiation electrodes 3-2 and 3-3 that operate near the additional radiation electrode 3-1 and the capacitor 52 constitute a parallel resonant circuit, and the parallel resonant circuit functions as a band stop filter.

For example, in the antenna configuration shown in FIG. 4(*d*) in which the switch elements 31 and 32 are in the on state and the switch element 33 is in the off state, as indicated by a broken line shown in FIG. 8, a parallel resonant circuit 50 is defined by the capacitor 52 and the inductor 51 of the additional radiation electrodes 3-1 and 3-2. If the resonant frequency for the antenna configuration shown in FIG. 4(*d*) is the resonant frequency f2, the antenna device shown in FIG. 8 also has the resonant frequency f2 unless the impedance of the parallel resonant circuit 50 is infinite. However, the parallel resonant circuit 50 has substantially an infinite impedance at a certain frequency f2'. At the frequency f2', therefore, no power is supplied to the electrode portions 3B of the additional radiation electrodes 3-1 and 3-2, and the parallel resonant circuit 50 functions as a band pass filter.

That is, at a frequency other than the resonant frequency f2', as shown in FIG. 9(*a*), an antenna configuration in which the additional radiation electrodes 3-1 and 3-2 are formed of the electrode portions 3A and 3B is obtained. Thus, resonance occurs at the frequency f2. At the frequency f2', however, the parallel resonant circuit 50 functions as a band stop filter and, as shown in FIG. 9(*b*), a new antenna configuration in which the additional radiation electrodes 3-1 and 3-2 include only the electrode portions 3A is obtained. Thus, resonance occurs at the frequency f2'.

Accordingly, in the antenna configuration shown in FIG. 4(*d*) in which only the switch elements 31 and 32 are in the on state, as indicated by a return loss curve S2 shown in FIG. 10, two resonant frequencies, i.e., the resonant frequency f2' at which the parallel resonant circuit 50 functions as a band stop filter and the resonant frequency f2 at which the parallel resonant circuit 50 does not function as a band stop filter, can be obtained.

According to the antenna device of this embodiment, therefore, two resonances can be obtained in the antenna configuration shown in FIG. 4(*d*), and two resonances can be obtained in each of the antenna configurations shown in FIGS. 4(*a*), (*c*), and (*g*) in which the switch element 31 is in the on state. A larger number of resonances than the number of resonances of the antenna devices of the first and second embodiments can be obtained.

In this embodiment, only the reactance circuit 5-1 is formed of the capacitor 52; however, the present invention is not limited thereto. Any of the reactance circuits 5-1 to 5-3 may be formed of a capacitor, or may be a reactance circuit including a capacitor, thus achieving the band stop filter described above.

The remaining structure, operation, and advantages are similar to those of the first and second embodiments, and a description thereof is thus omitted.

Fourth Embodiment

Next, a fourth embodiment will be described.

Figure 11:
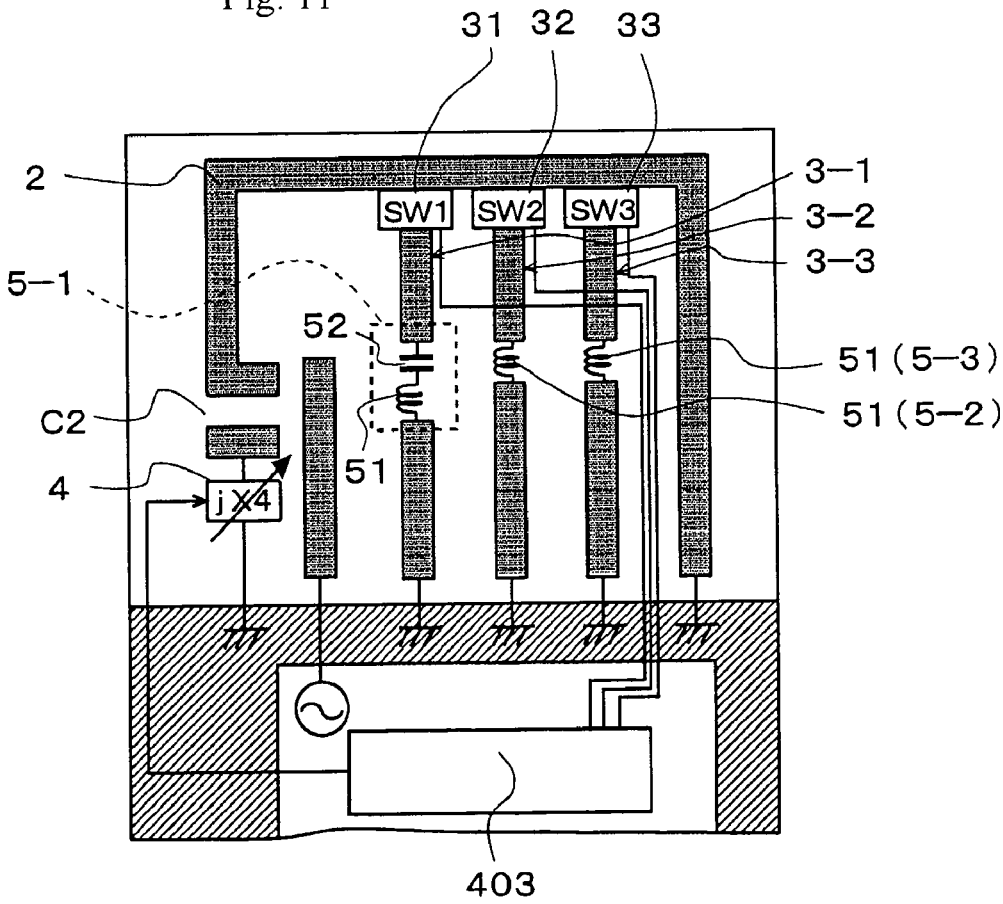
FIG. 11 is a plan view of an antenna device according to a fourth embodiment.

FIG. 11 is a plan view showing an antenna device according to the fourth embodiment.

The antenna device of this embodiment is different from the antenna devices of the first to third embodiments in that at least one reactance circuit of the reactance circuits 5-1 to 5-3 of the additional radiation electrodes 3-1 to 3-3 is formed of a series resonant circuit.

Specifically, as indicated by a broken line shown in FIG. 11, the reactance circuit 5-1 of the additional radiation electrode 3-1 is formed of a series resonant circuit including a capacitor 52 and an inductor 51, and each of the reactance circuits 5-2 and 5-3 is formed of an inductor 51.

The series resonant circuit operates in L mode (inductive mode) before a resonance point and in C mode (capacitive mode) after the resonance point. Therefore, at a frequency after the resonance point of the series circuit, the reactance circuit 5-1 can constitute a parallel resonant circuit with the inductors 51 of the reactance circuits 5-2 and 5-3, and the parallel resonant circuit can function as a band stop filter.

In this embodiment, only the reactance circuit 5-1 is formed of a series resonant circuit including the inductor 51 and the capacitor 52; however, the present invention is not limited thereto. Any of the reactance circuits 5-1 to 5-3 may be formed of a series resonant circuit.

The remaining structure, operation, and advantages are similar to those of the first to third embodiments, and a description thereof is thus omitted.

Fifth Embodiment

Next, a fifth embodiment will be described.

Figure 12:
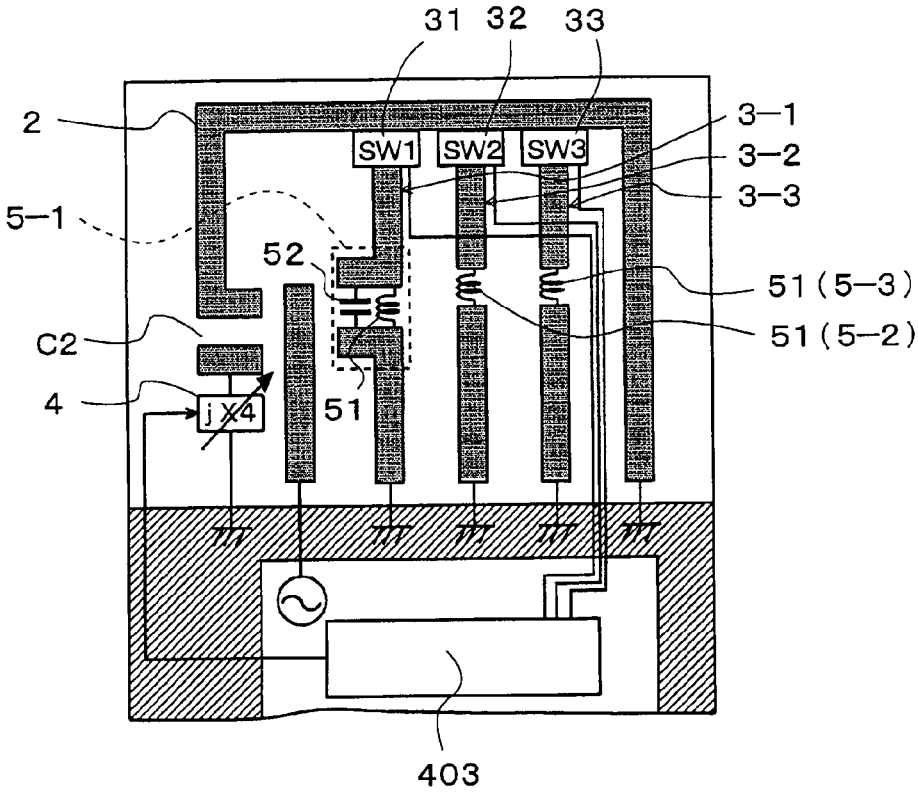
FIG. 12 is a plan view showing an antenna device according to a fifth embodiment.

FIG. 12 is a plan view showing an antenna device according to the fifth embodiment.

The antenna device of this embodiment is different from the antenna devices of the first to fourth embodiments in that at least one reactance circuit of the reactance circuits 5-1 to 5-3 of the additional radiation electrodes 3-1 to 3-3 is formed of a parallel resonant circuit.

Specifically, as indicated by a broken line shown in FIG. 12, the reactance circuit 5-1 of the additional radiation electrode 3-1 is formed of a parallel resonant circuit including a capacitor 52 and an inductor 51, and each of the reactance circuits 5-2 and 5-3 is formed of an inductor 51.

With this structure, the reactance circuit 5-1 can be set so as to have a larger reactance value than reactance values of the reactance circuits 5-2 and 5-3 including only the inductors 51.

In particular, a parallel resonant circuit can be set so as to have a larger reactance value than that of a series resonant circuit. Thus, the reactance value can further be increased.

Further, since the reactance circuit 5-1 itself is a parallel resonant circuit, even in a state where the switch elements 32 and 33 do not operate, the reactance circuit 5-1 can independently constitute a band stop filter.

Figure 13:
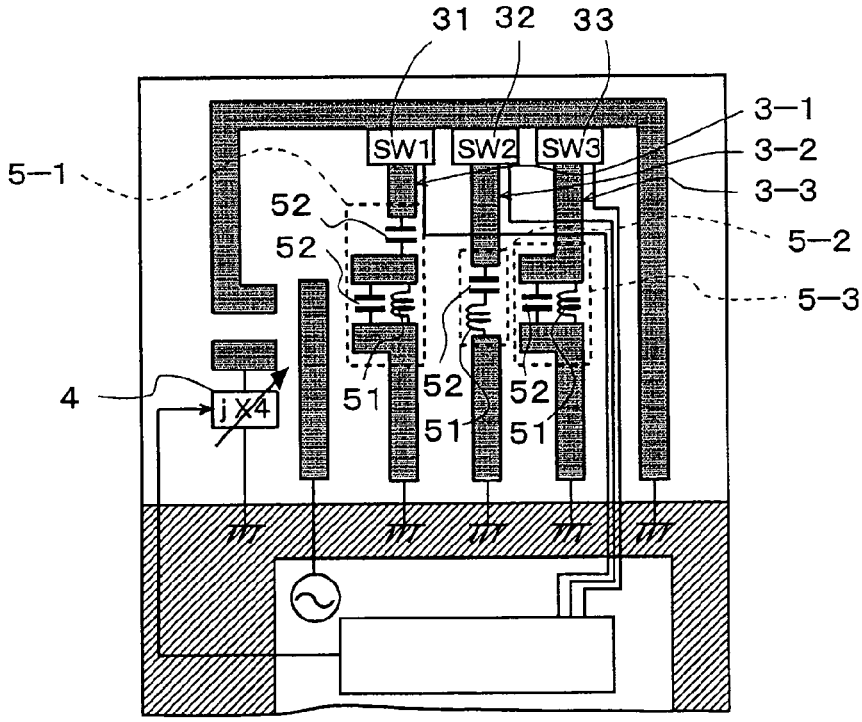
FIG. 13 is a plan view showing an example of a modification of the fifth embodiment.

In this embodiment, only the reactance circuit 5-1 is formed of a parallel resonant circuit including the inductor 51 and the capacitor 52; however, the present invention is not limited thereto. Any of the reactance circuits 5-1 to 5-3 may be formed of a parallel resonant circuit. Further, as shown in the modified embodiment of FIG. 13, the reactance circuits 5-1 to 5-3 of the additional radiation electrodes 3-1 to 3-3 may be a combination of series resonant circuits and parallel resonant circuits, and may include fixed reactance elements.

The remaining structure, operation, and advantages are similar to those of the first to fourth embodiments, and a description thereof is thus omitted.

Sixth Embodiment

Next, a sixth embodiment will be described.

Figure 14:
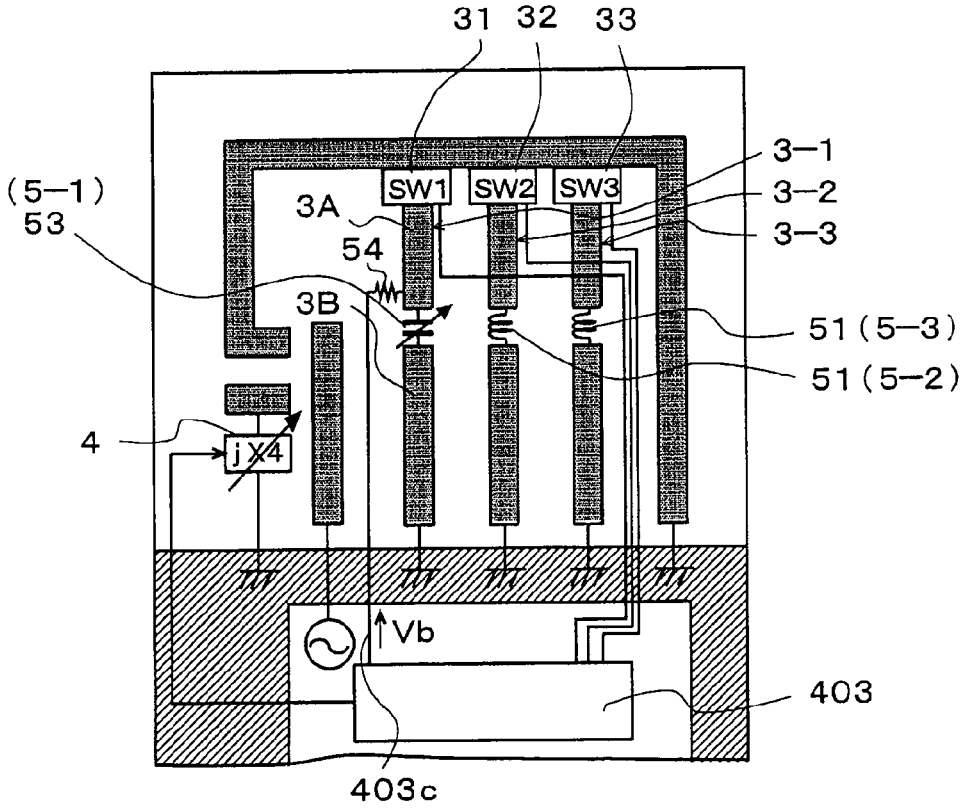
FIG. 14 is a plan view showing an antenna device according to a sixth embodiment.

FIG. 14 is a plan view showing an antenna device according to the sixth embodiment.

The antenna device of this embodiment is different from the antenna devices of the first to fifth embodiments in that at least one reactance circuit of the reactance circuits 5-1 to 5-3 of the additional radiation electrodes 3-1 to 3-3 includes a variable capacitance element.

Specifically, as shown in FIG. 14, the reactance circuit 5-1 of the additional radiation electrode 3-1 is formed of a varicap 53, and each of the reactance circuits 5-2 and 5-3 is formed of an inductor 51.

The varicap 53 is provided between electrode portions 3A and 3B of the additional radiation electrode 3-1 so that a cathode of the varicap 53 is connected to the electrode portion 3A and an anode thereof is connected to the electrode portion 3B. A line 403*c* from a control IC 403 is connected to the electrode portion 3A of the additional radiation electrode 3-1 through a resistor 54.

Therefore, a dc control voltage Vb is applied to the cathode side of the varicap 53 through the line 403*c* to thereby adjust the capacitance of the varicap 53.

With this structure, each resonant frequency can be continuously changed by the varicap 53 as well as continuously shifted by a variable capacitance element 4. Therefore, the antenna device can achieve more wideband characteristics.

In this embodiment, only the reactance circuit 5-1 is formed of the varicap 53; however, the present invention is not limited thereto. Any of the reactance circuits 5-1 to 5-3 may be formed of the varicap 53, or may include the varicap 53 and one or more other fixed or variable elements.

The remaining structure, operation, and advantages are similar to those of the first to fifth embodiments, and a description thereof is thus omitted.

Seventh Embodiment

Next, a seventh embodiment will be described.

Figure 15:
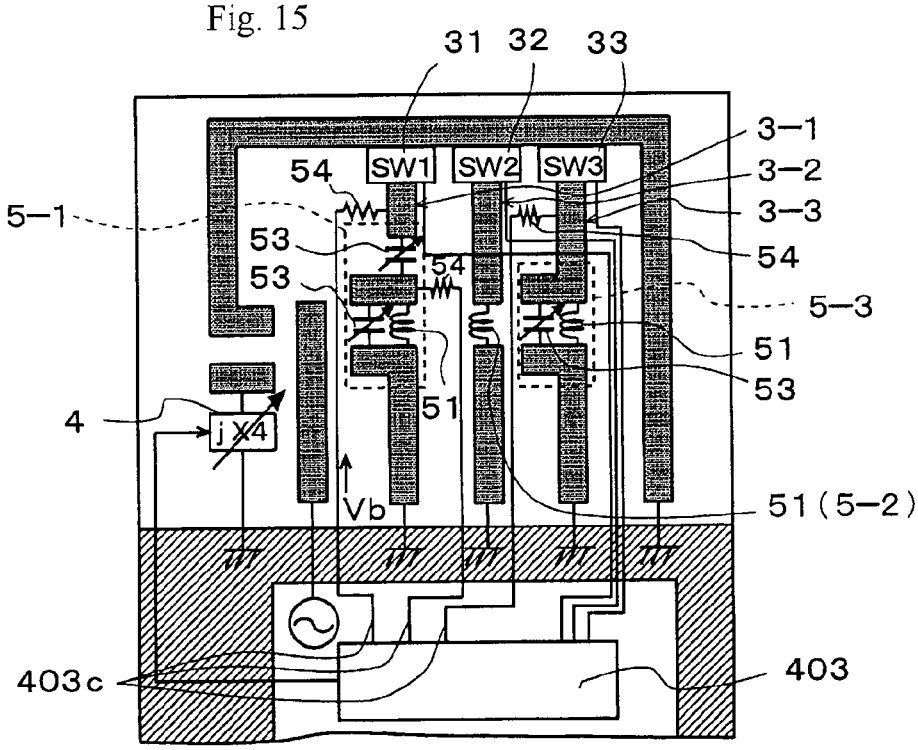
FIG. 15 is a plan view showing an antenna device according to a seventh embodiment.

FIG. 15 is a plan view showing an antenna device according to the seventh embodiment.

The antenna device of this embodiment is different from the antenna device of the sixth embodiment in that at least one reactance circuit of the reactance circuits 5-1 to 5-3 of the additional radiation electrodes 3-1 to 3-3 is formed of a series resonant circuit or parallel resonant circuit each including a variable capacitance element.

Specifically, as shown in FIG. 15, the reactance circuit 5-1 is formed of a series resonant circuit in which a varicap 53 is connected in series with a parallel circuit including a varicap 53 and an inductor 51, the reactance circuit 5-2 is formed of an inductor 51, and the reactance circuit 5-3 is formed of a parallel resonant circuit including a varicap 53 and an inductor 51.

Lines 403*c* from a control IC 403 are connected to the cathode side of the varicaps 53 of the reactance circuits 5-1 and 5-3 through resistors 43, and a dc control voltage Vb is applied though the lines 403*c* to thereby adjust the capacitance of the varicaps 53.

With this structure, the reactance of the reactance circuits 5-1 and 5-3 constituting the series resonant circuit and the parallel resonant circuit is changed by the varicaps 53, whereby resonant frequencies can be continuously shifted in a wide range. In particular, the parallel resonant circuit can be used to rapidly change a resonant frequency in a wide range.

In this embodiment, the reactance circuit 5-1 is a series resonant circuit and the reactance circuit 5-3 is a parallel resonant circuit; however, the present invention is not limited thereto. Any of the reactance circuits 5-1 to 5-3 may be formed of a series resonant circuit or a parallel resonant circuit.

The remaining structure, operation, and advantages are similar to those of the sixth embodiment, and a description thereof is thus omitted.

Eighth Embodiment

Next, an eighth embodiment will be described.

Figure 16:
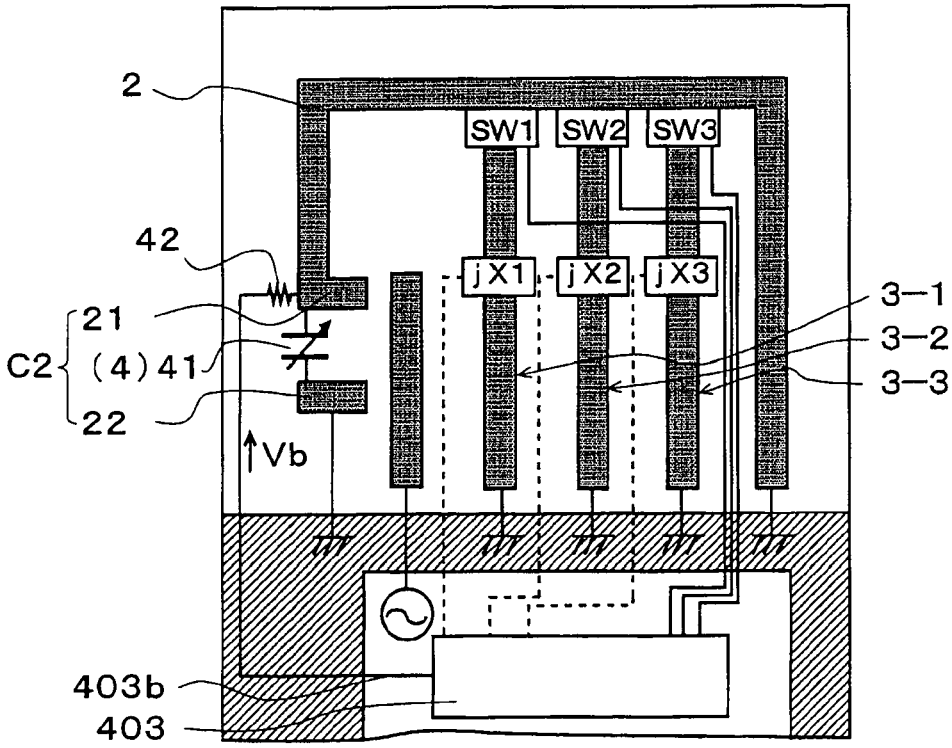
FIG. 16 is a plan view showing an antenna device according to an eighth embodiment.

FIG. 16 is a plan view showing an antenna device according to the eighth embodiment.

In the first to seventh embodiments, an antenna device in which the variable capacitance element 4 is connected in series with the capacitor portion C2 is used by way of example. However, as shown in FIG. 16, the antenna device of this embodiment is configured such that the variable capacitance element 4 is connected in parallel with the capacitor portion C2.

Specifically, the variable capacitance element 4 is implemented by a varicap 41. A cathode of the varicap 41 is connected to an electrode portion 21 of the capacitor portion C2 and an anode thereof is connected to an electrode portion 22.

A line 403*b* from a control IC 403 is connected to the electrode portion 21 of the capacitor portion C2 through a resistor 42, and a dc control voltage Vb is applied to the cathode side of the varicap 41 through the line 403*b*.

With this structure, the capacitance of the varicap 41 is changed by the dc control voltage Vb, whereby resonant frequencies for each antenna configuration can be continuously changed, which is similar to that in the foregoing embodiments. However, deviations between the resonant frequencies are small compared with the foregoing embodiments in which the variable capacitance element 4 is connected in series with the capacitor portion C2. With the use of the structure of this embodiment, therefore, precise adjustment of antenna matching can be achieved by the dc control voltage Vb.

The remaining structure, operation, and advantages are similar to those of the first to seventh embodiments, and a description thereof is thus omitted.

Ninth Embodiment

Next, a ninth embodiment will be described.

Figure 17:
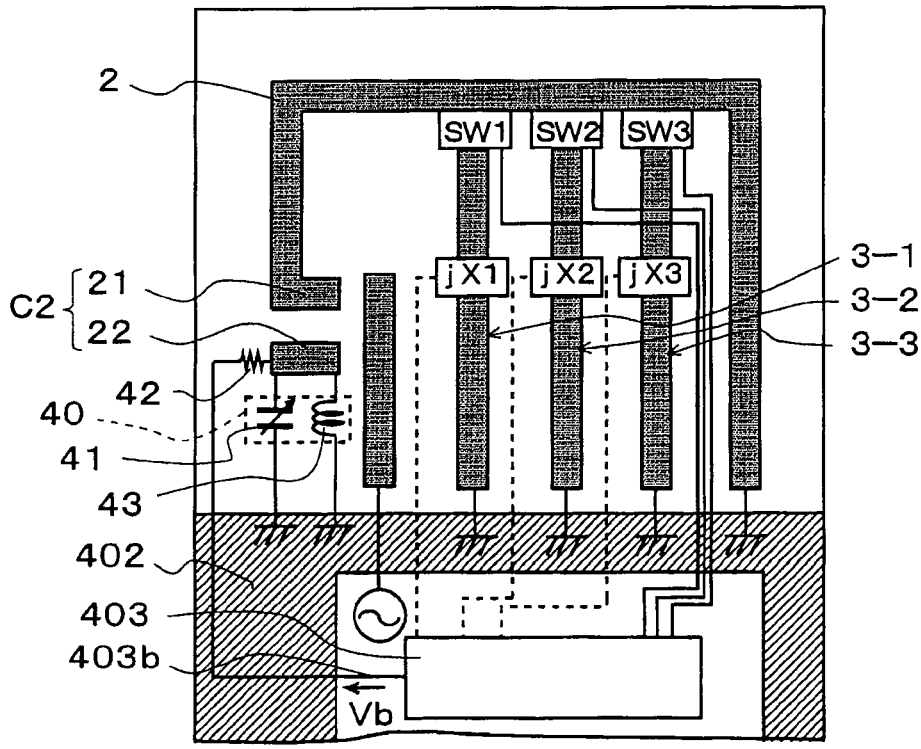
FIG. 17 is a plan view showing an antenna device according to a ninth embodiment.

FIG. 17 is a plan view showing an antenna device according to the ninth embodiment.

The antenna device of this embodiment has a structure in which, as shown in FIG. 17, a parallel resonant circuit 40 including a variable capacitance element 4 is connected in series with a capacitor portion C2.

Specifically, a cathode of a varicap 41 serving as the variable capacitance element 4 is connected to an electrode portion 22 of the capacitor portion C2, and an anode thereof is grounded. One end of an inductor 43 is connected to the electrode portion 22 and the other end is grounded.

A line 403*b* from a control IC 403 is connected to the electrode portion 22 of the capacitor portion C2 through a resistor 42, and a dc control voltage Vb is applied to the cathode side of the varicap 41 through the line 403*b*.

With this structure, the capacitance of the varicap 41 is changed by the dc control voltage Vb, thereby obtaining a significantly large deviation between resonant frequencies compared with the above-described first to seventh embodiments in which the variable capacitance element 4 is connected in series with the capacitor portion C2 or the eighth embodiment in which the variable capacitance element 4 is connected in parallel with the capacitor portion C2. With the use of the structure of this embodiment, therefore, a resonant frequency can be rapidly changed by the dc control voltage Vb.

The remaining structure, operation, and advantages are similar to those of the first to eighth embodiments, and a description thereof is thus omitted.

Tenth Embodiment

Next, a tenth embodiment will be described.

Figure 18:
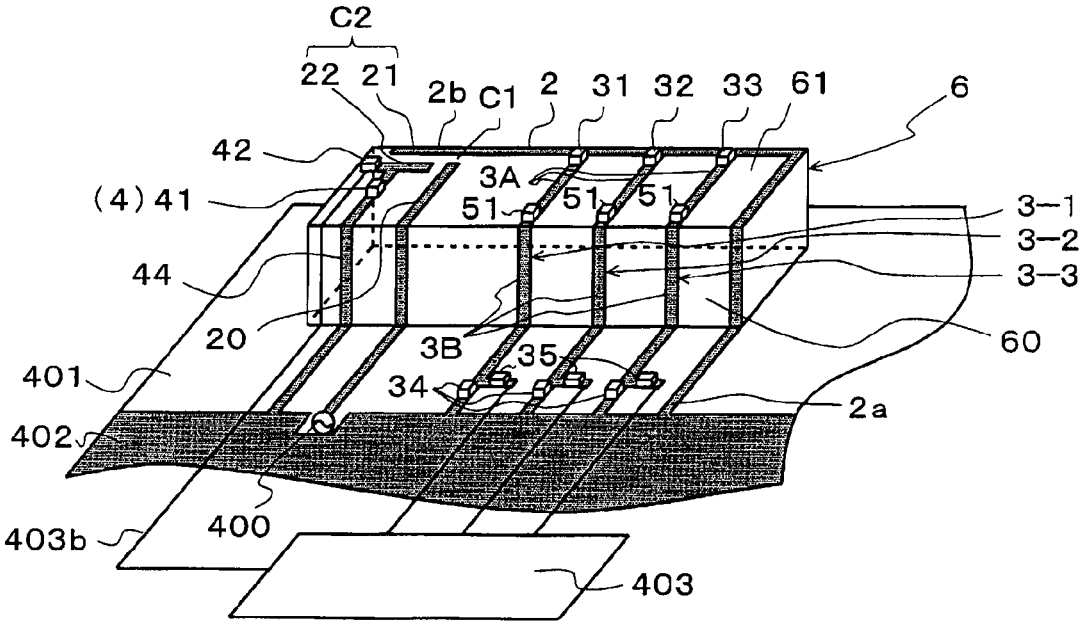
FIG. 18 is a perspective view showing an antenna device according to a tenth embodiment.

FIG. 18 is a perspective view showing an antenna device according to the tenth embodiment.

As shown in FIG. 18, this embodiment has a structure in which the radiation electrode 2 and the additional radiation electrodes 3-1 to 3-3 of the antenna device of the second embodiment described above are patterned on a dielectric substrate 6.

Specifically, the dielectric substrate 6 that is shaped into rectangular parallelepiped having a front surface 60 and a top surface 61 is mounted in a non-ground region 401 on a circuit board.

A feed electrode 20 is drawn onto the non-ground region 401 from a feed unit 400, and is patterned over the top surface 61 from the front surface 60 of the dielectric substrate 6.

Further, the radiation electrode 2 is disposed on the far side of the top surface 61 of the dielectric substrate 6 as viewed in the figure, and a left end portion of the radiation electrode 2 serves as a proximal end portion 2*b*. A capacitor portion C1 is defined by a space between the proximal end portion 2*b* and a distal end portion of the feed electrode 20. The radiation electrode 2 extends to the right from the proximal end portion 2*b* up to the front surface 60 along the right edge of the top surface 61, and extends down on the front surface 60. Thereafter, the radiation electrode 2 extends through the non-ground region 401 and a distal end portion 2*a* of the radiation electrode 2 is connected to a ground region 402.

The additional radiation electrodes 3-1 (3-2 and 3-3) are patterned in a direction vertical to the additional radiation electrodes 3-1 to 3-3, and distal end portions of the additional radiation electrodes 3-1 (3-2 and 3-3) are connected to the ground region 402.

Specifically, electrode portions 3A of the additional radiation electrodes 3-1 (3-2 and 3-3) are patterned on the top surface 61, and Schottky diodes 31 (32 and 33) are mounted between the electrode portions 3A and the radiation electrode 2. Electrode portions 3B are patterned over the non-ground region 401 from the front surface 60, and inductors 51 serving as reactance circuits 5-1 (5-2 and 5-3) are mounted between the electrode portions 3B and the electrode portions 3A. Each of the electrode portions 3B is further separated at a part near the ground region 402, and is provided with a capacitor 34 therebetween. Resistors 35 are connected to the electrode portions 3B, and the resistors 35 and a control IC 403 are connected through lines 403*a*.

On the other hand, a capacitor portion C2 is defined in a left part of the top surface 61 of the dielectric substrate 6.

Specifically, the proximal end portion 2*b* of the radiation electrode 2 serves as an electrode portion 21, and an electrode portion 22 is patterned in parallel to the electrode portion 21 so that the capacitor portion C2 is defined by the opposing electrode portions 21 and 22. A pattern 44 is formed onto the front surface 60 from the vicinity of the center of the electrode portion 22, and extends down on the front surface 60. Thereafter, the pattern 44 extends through the non-ground region 401 and a distal end portion of the pattern 44 is connected to the ground region 402. A varicap 41 serving as a variable capacitance element 4 is mounted between the pattern 44 and the electrode 22. Thereafter, a resistor 42 is connected to the electrode portion 22, and the resistor 42 and the control IC 403 are connected through a line 403*b*.

With this structure, the capacitance value of the capacitor portion C1 between the feed electrode 20 and the radiation electrode 2, the capacitance value of the capacitor portion C2 between the electrode portions 21 and 22, and capacitance values between all electrodes can be increased by the dielectric substrate 6. Therefore, a substantially long antenna length can be obtained using a short electrode, resulting in a reduction in size of the antenna device.

In this embodiment, the antenna device of the second embodiment is used by way of example; however, examples of applications to the dielectric substrate 6 are not limited thereto. The antenna devices of the first to ninth embodiments and antenna devices of all embodiments that fall within the scope of the present invention can be applied to the dielectric substrate 6.

The remaining structure, operation, and advantages are similar to those of the first to ninth embodiments, and a description thereof is thus omitted.

Although particular embodiments have been described, many other variations and modifications and other uses will become apparent to those skilled in the art. Therefore, the present invention is not limited by the specific disclosure herein.

What is claimed is:

1. An antenna device comprising:

a radiation electrode including a proximal end portion to which power is to be capacitively fed through a first capacitor portion and a distal end portion which is grounded to a ground region; and a plurality of additional radiation electrodes, each of the plurality of additional radiation electrodes being branched from the radiation electrode through a switch element and a distal end portion thereof being grounded; wherein the proximal end portion of the radiation electrode is provided with a second capacitor portion that includes opposing electrode portions, at which a maximum voltage is obtained when power is fed, and a variable capacitance element is connected to the second capacitor portion and is grounded;

a respective reactance circuit is provided in each of the plurality of additional radiation electrodes; and the radiation electrode includes a first portion that extends from the first capacitor portion away from the ground region and a second portion that extends towards the ground region in an area of the distal end portion.

2. The antenna device according to claim 1, wherein at least one reactance circuit of the respective reactance circuits provided in the plurality of additional radiation electrodes includes a capacitor.

3. The antenna device according to claim 2 wherein at least one reactance circuit of the respective reactance circuits provided in the plurality of additional radiation electrodes includes a variable capacitance.

4. The antenna device according to claim 3, wherein the variable capacitance element is connected in series or in parallel with the second capacitor portion.

5. The antenna device according to claim 3, wherein a parallel resonant circuit including the variable capacitance element is connected in series with the second capacitor portion.

6. The antenna device according to claim 5, wherein at least one reactance circuit of the respective reactance circuits provided in the plurality of additional radiation electrodes is a series resonant circuit or a parallel resonant circuit.

7. The antenna device according to claim 1, wherein at least one reactance circuit of the respective reactance circuits provided in the plurality of additional radiation electrodes includes a variable capacitance element.

8. The antenna device according to claim 7, wherein the variable capacitance element is connected in series or in parallel with the second capacitor portion.

9. The antenna device according to claim 7, wherein a parallel resonant circuit including the variable capacitance element is connected in series with the second capacitor portion.

10. The antenna device according to claim 1, wherein the radiation electrode and the plurality of additional radiation electrodes are patterned on a dielectric substrate.

11. A wireless communication apparatus comprising the antenna device according to claim 1, and a feed unit connected to the antenna device to feed power to said proximal end portion of the radiation electrode.

* * * * *